United States Patent [19]

Maurer

[11] Patent Number: 4,610,355

[45] Date of Patent: Sep. 9, 1986

[54] SHIPPING BASE HAVING AN ENTRY SLOT FOR MECHANICAL MATERIAL HANDLING EQUIPMENT

[75] Inventor: Donald J. Maurer, Cedar Rapids, Iowa

[73] Assignee: Amana Refrigeration, Inc., Amana, Iowa

[21] Appl. No.: 732,110

[22] Filed: May 9, 1985

[51] Int. Cl.[4] ..... B65D 19/00

[52] U.S. Cl. ..... 206/386; 206/497; 206/523; 206/586; 206/599; 108/51.3

[58] Field of Search ..... 206/386, 497, 523, 597, 206/586, 599; 220/902; 108/56.1, 56.3, 51.3

[56] References Cited

U.S. PATENT DOCUMENTS

| | | | |
|---|---|---|---|
| 1,585,684 | 5/1926 | Oppenheim | 206/586 |
| 2,753,101 | 7/1956 | Zimmerman | 206/586 |
| 2,808,978 | 10/1957 | Wright et al. | 206/586 |
| 3,202,335 | 8/1965 | Budd | 206/586 |
| 3,356,209 | 12/1967 | Prezely, Jr. | 206/523 |
| 3,442,436 | 5/1969 | Kirby, Jr. | 206/497 |
| 3,451,534 | 6/1969 | Remer et al. | 206/523 |
| 3,493,107 | 2/1970 | Markey | 206/497 |
| 3,495,756 | 2/1970 | Achermann et al. | 206/386 |
| 3,701,465 | 10/1972 | Richter | 206/523 |
| 3,828,965 | 8/1974 | Yarbrough | 206/523 |
| 4,042,107 | 8/1977 | Kendig | 206/597 |
| 4,113,096 | 9/1978 | Scott | 206/523 |
| 4,133,430 | 1/1979 | Cravens | 206/497 |
| 4,378,743 | 4/1983 | McFarland | 206/599 |

*Primary Examiner*—Joseph Man-Fu Moy
*Assistant Examiner*—David T. Fidei
*Attorney, Agent, or Firm*—William R. Clark

[57] ABSTRACT

A shipping base for elevating the bottom of a load to provide an entry slot for a mechanical lifting device. Cardboard is cut and folded to form a horizontal panel integrally connected to upward-facing rectangular channels along opposing panel edges. Polystyrene shipping pads are inserted in the channels for supporting the weight of an item to be shipped and partially encapsulating the item.

7 Claims, 9 Drawing Figures

SHIPPING BASE HAVING AN ENTRY SLOT FOR MECHANICAL MATERIAL HANDLING EQUIPMENT

BACKGROUND OF THE INVENTION

This invention relates generally to cardboard shipping containers which require mechanical material handling equipment.

As is well known, it is desirable to partially encapsulate the top and bottom edges of an item to be shipped for protection against shock and vibration. It has also been conventional to suspend the encapsulated item in a cardboard carton wherein the encapsulating material acts as a spacing block separating carton walls from the item. In this manner, foreign objects penetrating the carton will not come in contact with the item. The encapsulating material must have sufficient load bearing capability to support the weight of multiple items which are often stacked one on top of the other. For items of sufficient weight to require mechanical material handling equipment, however, a problem arises. A conventional container has a flat bottom which does not provide entry for material handling equipment such as, for example, the protruding forks of a forklift truck.

The prior art approach was to mount the container on a conventional full perimeter pallet or skid. Several disadvantages are readily apparent with this approach. First, the added height of the pallet reduces the number of containers which may be placed in a finite space such as the trailer of a transporting truck. Second, custom made pallets are often required since the bottom surface of the carton rarely has the same perimeter as a conventional pallet. Third, added costs are incurred by obtaining pallets and mounting the item thereon.

SUMMARY OF THE INVENTION

It is an object of the invention to provide a shipping base for elevating an item to be shipped thereby providing an entry slot for insertion of a mechanical lifting device.

It is a further object of the invention to form the shipping base from a unitary sheet of material.

It is another object of the invention to utilize conventional shipping pads to support the load of a shipping item and incorporate these pads into the base.

It is an additional object of the invention to protect a shipping item against shock and vibration by partially encapsulating the item.

These and other objects are realized in accordance with the present invention which defines a shipping base having an entry slot adapted for insertion of a lifting device comprising a sheet of foldable material defining a rectangular horizontal panel having two parallel side troughs respectively formed by downward, outward and upward bends from opposing edges of the panel, the entry slot being defined by the space between the troughs, and a pair of joists, each joist being positioned in each of the troughs for supporting a load. It may be preferable for the sheet of foldable material to be comprised of cardboard. It may also be preferable for the pair of joists to be comprised of polystyrene.

The invention may further be defined by a shipping base for protecting the bottom of a load and elevating the load to provide an entry slot for a mechanical lifting apparatus, comprising a rectangular horizontal panel, a pair of upward-facing channels disposed along and integrally connected to opposing edges of the panel, the panel and the channels being formed from a unitary sheet of material, the entry slot being defined by the space between the channels and below the panel, and a plurality of polymer blocks for partially enclosing and protecting the load bottom, the blocks being positioned in each of the channels for supporting the load. As a result of being positioned in the channels, the polystyrene blocks are protected against damage which may otherwise occur during shipping. The sheet of material may be cardboard wherein cardboard is hereinafter defined as any composition of materials containing cardboard, such as, for example, a composition of wax and cardboard. The shipping base may be designed to fit the contour of almost any load which is partially encapsulated by protective blocks or pads in a conventional manner.

The invention further defines a shipping base for protecting the bottom of a load and elevating the load to provide an entry slot adapted for insertion of projecting prongs from a lifting device, comprising a rectangular horizontal panel having first and second pairs of opposing edges, a pair of upward facing rectangular vertical channels disposed along and integrally connected to the first pair of horizontal panel edges, the entry slot being defined by the space between the channels and below the horizontal panel, each of the channels having an outer rectangular vertical wall parallel to and spatially separated from the first pair of horizontal panel edges, the outer walls being greater in height than the vertical distance below the horizontal panel, the outer walls defining a first pair of upwardly extending rectangular vertical panels, a second pair of upwardly extending rectangular vertical panels integrally connected to the second pair of horizontal panel edges, each of the second vertical panels being positioned between the first pair of vertical panels, the second and first pair of vertical panels defining an open rectangular enclosure for partially enclosing the load, the panels and the channels being integrally formed from a unitary sheet of cardboard, and a pair of polymer pads for partially enclosing and protecting the load, each of the pads being positioned in each of the channels for supporting the load. It may be preferable for the shipping base to include a quadruplicate of vertical flaps, each of the flaps being integrally attached to an opposing transverse edge of the first pair of rectangular vertical panels, the flaps being orthogonally bent from the first pair of panels thereby being adjacently disposed to the second pair of vertical panels, the flaps being integrally formed from the unitary sheet of cardboard, and means for attaching the flaps to the second pair of vertical panels. Conventional stapling or adhesive bonding may be used for the attaching means.

The invention may further be defined by a shipping base for protecting the bottom of a load and elevating the load to provide an entry slot for a mechanical lifting apparatus, comprising a horizontal rectangular panel having first and second pairs of opposing edges, a pair of upward-facing rectangular vertical channels, each of the channels having opposing first and second rectangular vertical walls, each of the first walls having an upper edge being disposed along and integrally connected to one edge of the first pair of horizontal panel edges, the entry slot being defined by the space between the first walls and below the horizontal panel, the second walls defining a first pair of rectangular vertical panels wherein the second walls are greater in height than the first walls, a second pair of rectangular vertical panels each extending upward from and being integrally attached respectively to one of the second pair of horizontal panel edges, each of the second vertical panels being positioned between and attached to the first pair of vertical panels, the first and second pair of vertical panels defining an open rectangular enclosure for partially enclosing the load, the panels and the channels being integrally formed from a unitary sheet of cardboard, and a pair of polymer joists respectively positioned in the channels for supporting the load, the joists also partially enclosing and protecting the bottom of the load. It may be preferable for the shipping base to include a pair of polymer pads for partially enclosing and protecting the top of the load. It may also be preferable for the shipping base to include a structure for encapsulating the load and the pair of polymer pads, and means for attaching the structure to the shipping base. A conventional cardboard sleeve may be utilized for the encapsulating structure. The attaching means may be a conventional steel or plastic band placed under tension. As an alternative, conventional plastic shrink or stretch wrap may be used for both the encapsulating structure and attaching means.

The invention further may be practiced by a method for forming a shipping base for elevating the bottom of a load to provide an entry slot for a mechanical lifting device, the shipping base having a horizontal rectangular panel integrally connected to a pair of upwardly-facing channels along opposing edges of the panel, the method comprising the steps of bending opposing sides of a rectangular sheet of cardboard downwardly, outwardly and then upwardly to form the parallel channels along both of the opposing panel edges, and positioning a shipping pad in each of the channels for supporting the load.

BRIEF DESCRIPTION OF THE DRAWINGS

The objects and advantages described herein will be more fully understood by reading the Description of the Preferred Embodiment with reference to the drawings wherein.

DESCRIPTION OF THE PREFERRED EMBODIMENT

Figure 1:
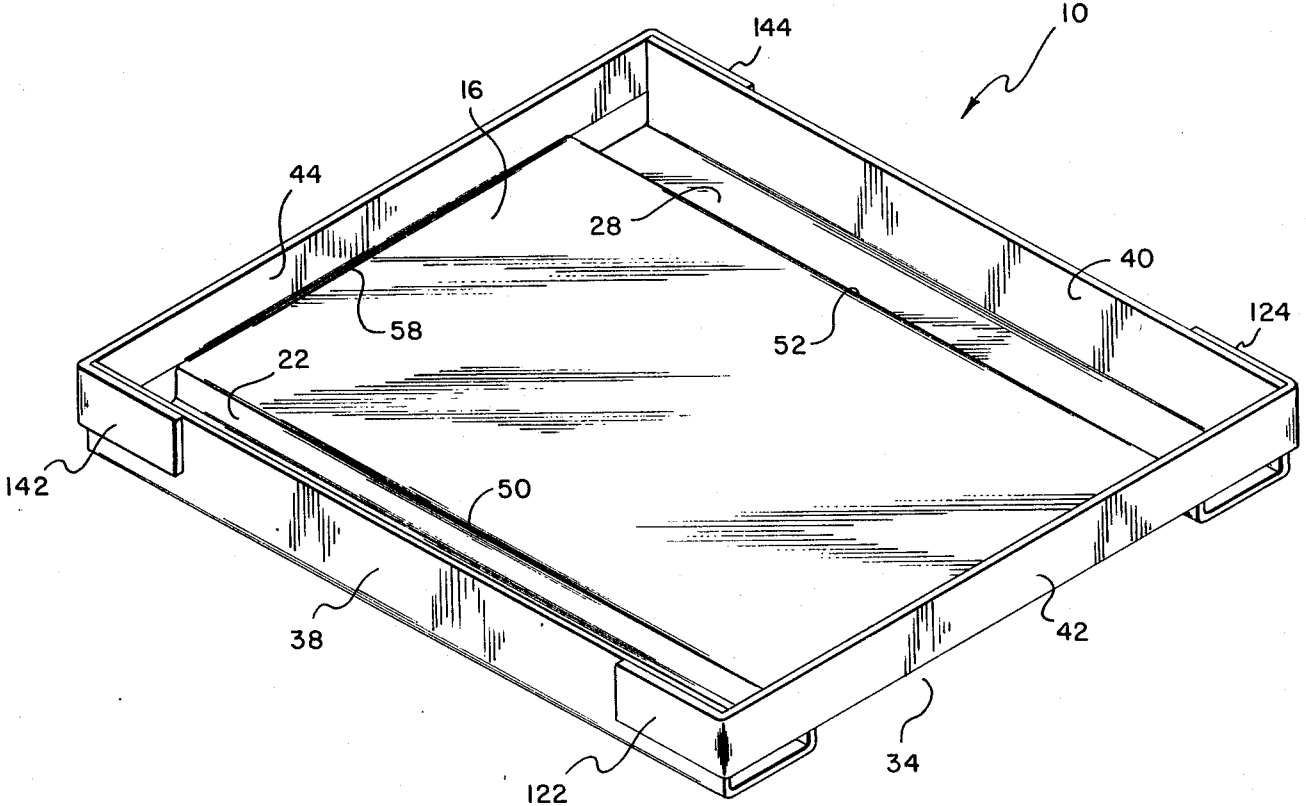
FIG. 1 is a perspective view of the shipping base shown without the polystyrene shipping pads.

Referring first to FIG. 1, shipping base 10 is broadly defined by horizontal panel 16, and upwardfacing rectangular channels 22 and 28 which are integrally connected to panel 16. Channels 22 and 28 elevate panel 16 thereby providing an entry slot 34 defined by the space below panel 16 and between channels 22 and 28. Slot 34 is suitable for providing entry by mechanical lifting equipment such as, for example, the protruding forks of a conventional fork lift truck. The outer walls of channels 22 and 28 respectively define vertical side panels 38 and 40 of shipping base 10. Finally, shipping base 10 has vertical end panels 42 and 44 which are integrally connected to panel 16. Panels 38, 40, 42 and 44 provide partial enclosure of an item to be shipped by use of shipping base 10.

Figure 2:
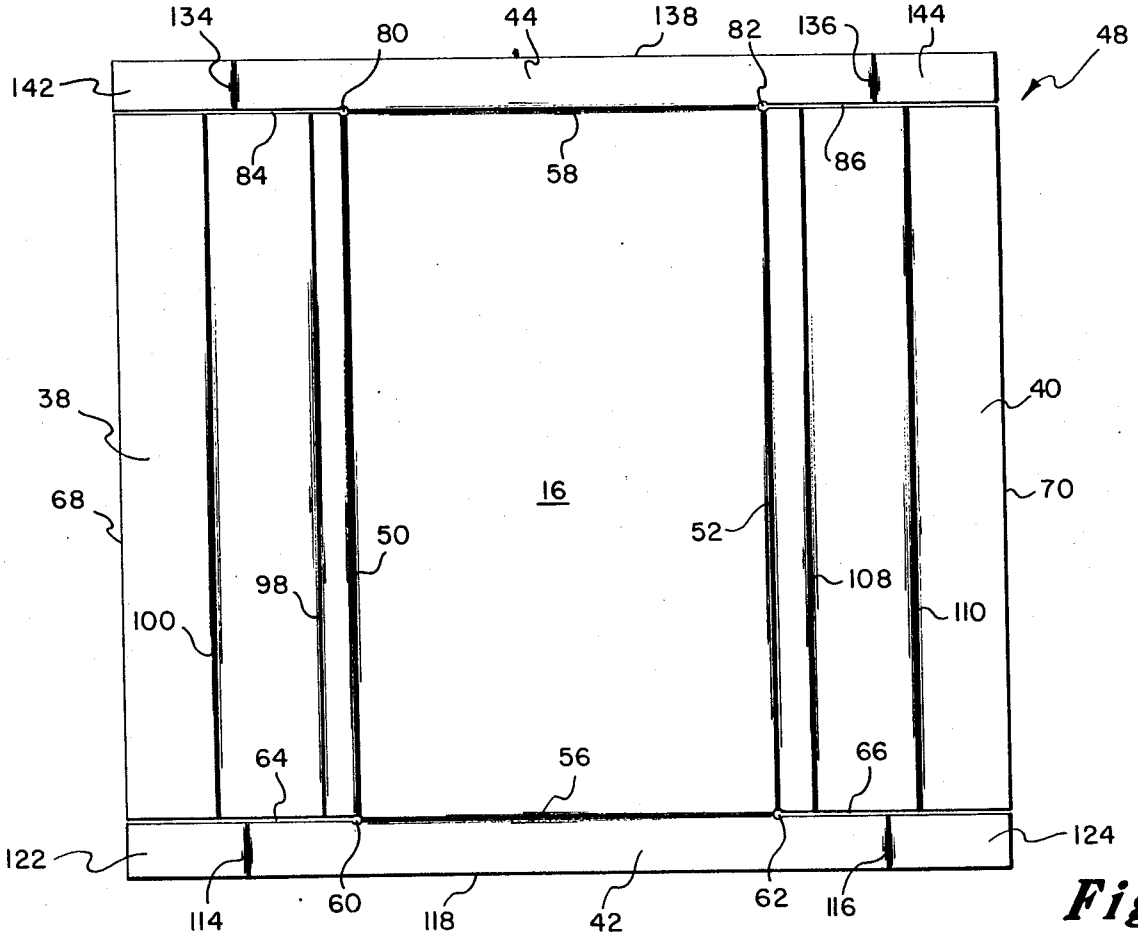
FIG. 2 is a plan view of the unitary sheet of cardboard from which the shipping base is foldably formed.

As illustrated in FIG. 2, shipping base 10 is foldably formed from a unitary rectangular sheet 48 of foldable material such as, for example, cardboard. Horizontal panel 16 is formed in the interior portion of sheet 48 by opposing longitudinal score lines 50 and 52, in addition to opposing transverse score lines 56 and 58.

Transverse score line 56 extends between punch holes 60 and 62. Slits 64 and 66 extend from holes 60 and 62, respectively, to opposing longitudinal edges 68 and 70, respectively, of sheet 48. Similarly, transverse score line 58 extends between punch holes 80 and 82. Slits 84 and 86 extend from respective holes 80 and 82 to opposing longitudinal edges 68 and 70, respectively, of sheet 48. Punch holes 60, 62, 80 and 82 prevent slits 64, 66, 84 and 86 from tearing sheet 48. Slits 64, 66, 84 and 86 are cut through sheet 48 to separate panels 42 and 44 from channels 22 and 28 as will be described later herein.

Continuing with sheet 48, longitudinal score lines 98 and 100 are spaced between longitudinal score line 50 and longitudinal edge 68 of sheet 48. Lines 98 and 100 extend between slits 64 and 84, respectively. Likewise, longitudinal score lines 108 and 110 are spaced between longitudinal score line 52 and longitudinal edge 70 of sheet 48. Lines 108 and 110 extend between slits 66 and 86, respectively. As described below, channel 22 is defined by lines 50, 98 and 100; channel 28 is defined by lines 52, 108 and 110.

Figure 3:
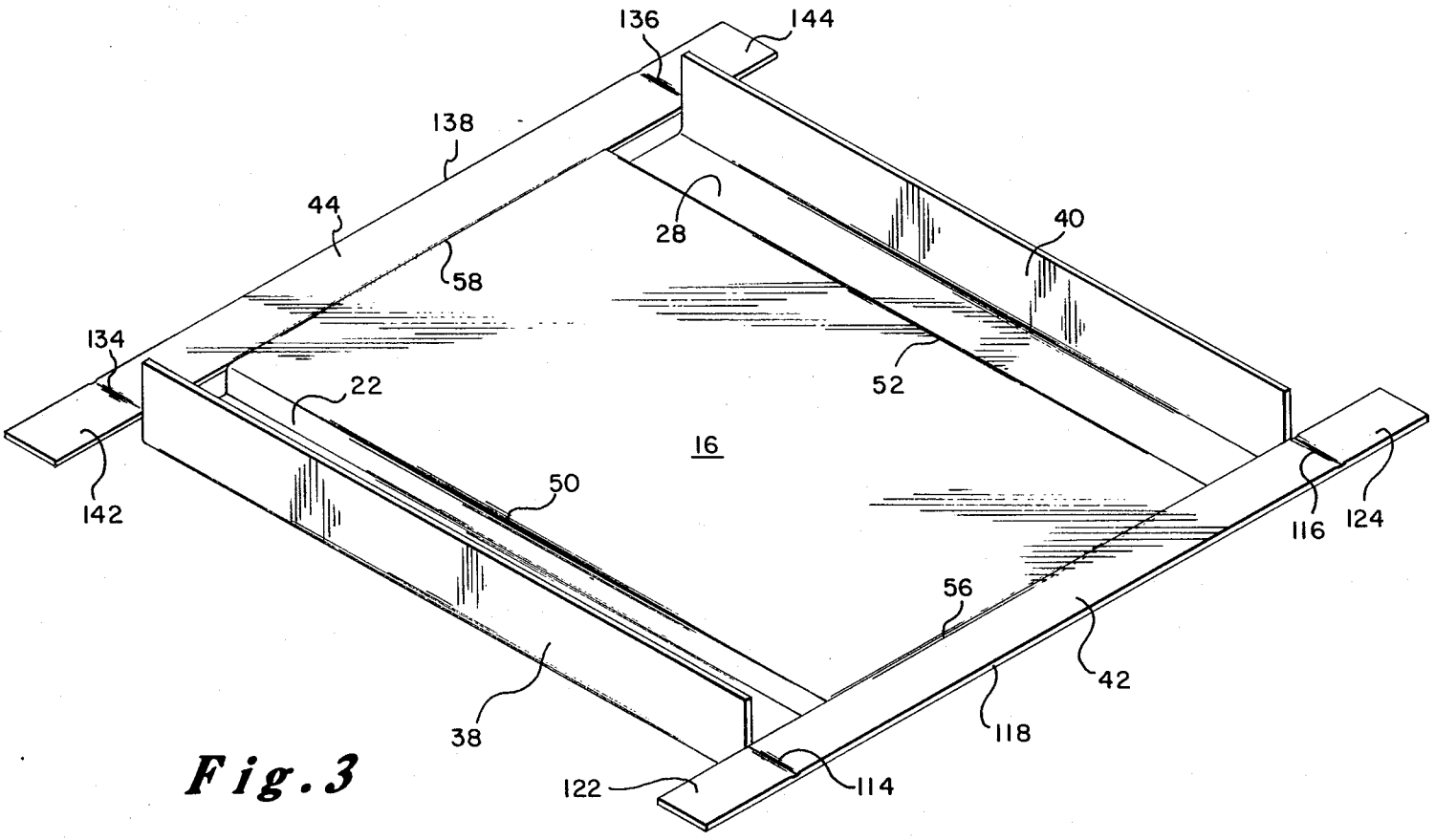
FIG. 3 is a perspective view of a partially assembled shipping base.

Still referring to FIG. 2 and also to FIG. 3 which is a perspective view of shipping base 10 shown partially assembled, rectangular channel 22 is defined by a downward vertical bend in sheet 48 along score line 50, an outward horizontal bend along score line 98, and an upward vertical bend along score line 100. More particularly, the downward vertical bend defines an inner rectangular vertical wall of channel 22 between score lines 50 and 98; the outward horizontal bend defines a bottom rectangular horizontal wall of channel 22 between score lines 98 and 100; and the upward vertical bend defines an outer rectangular vertical wall of channel 22 between score line 100 and longitudinal edge 68. Similarly, rectangular channel 28 is defined by a downward vertical bend in sheet 48 along score line 52, an outward horizontal bend along score line 108, and an upward vertical bend along score line 110. More particularly, the downward vertical bend defines an inner rectangular vertical wall of channel 28 between score lines 52 and 108; the outward horizontal bend defines a bottom rectangular horizontal wall of channel 28 between score lines 108 and 110; and the upward vertical bend defines an outer rectangular vertical wall of channel 28 between score line 110 and longitudinal edge 70. The space between channels 22 and 28, and below panel 16 defines entry slot 34. Further, vertical side panels 38 and 40 are respectively defined by the outer rectangular vertical walls of channels 22 and 28. Lines 50, 52, 98, 100, 108 and 110 may be partially perforated to prevent sheet 48 from buckling when folded.

Longitudinal score lines 114 and 116 extend from respective slits 64 and 66 to transverse edge 118. Likewise, longitudinal score lines 134 and 136 extend from respective slits 84 and 86 to transverse edge 138. As described below, flaps 122 and 124 are defined by lines 114 and 116; flaps 142 and 144 are defined by lines 134 and 136.

Still referring to FIGS. 1–3, an upward vertical bend in sheet 48 along score line 56 in addition to perpendicular bends towards side panels 38 and 40 along respective score lines 114 and 116 define vertical end panel 42. Furthermore, the perpendicular bends along score lines 114 and 116 define flaps 122 and 124, respectively. Similarly, an upward vertical bend in sheet 48 along score line 58 in addition to perpendicular bends towards panels 38 and 40 along respective score lines 134 and 136 define vertical end panel 44. The perpendicular bends along score lines 134 and 136 define flaps 142 and 144, respectively.

Flaps 122 and 142 are attached to panel 38 by adhesive bonding or other suitable means such as, for example, staples. Similarly, flaps 124 and 144 are attached to panel 40. A rigid shipping base 10 is thereby formed as illustrated in FIG. 1. Those skilled in the art, however, will recognize that the invention is not limited by the configuration shown. There are numerous other configurations possible. For example, it may be preferable for slits 64, 66, 84 and 86 to be disposed in a partially diagonal, rather than transverse direction, wherein panels 122, 124, 142 and 144 would have a greater width than illustrated. In this manner, added rigidity may be provided to shipping base 10. It is also possible to have configurations without panels 38, 40, 42 and 44. Further, channels 22 and 28 may be positioned in any location which would provide entry by material handling equipment.

Figure 4:
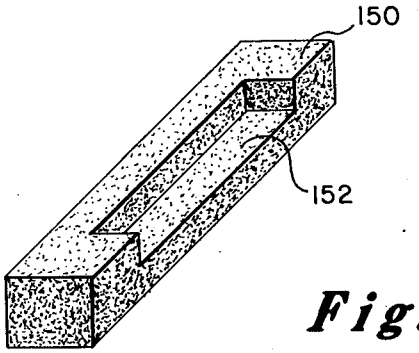
FIG. 4 is a perspective view of a polystyrene shipping pad.

Referring now to FIG. 4, there is shown a conventional shipping pad 150 which may be composed of any material commonly used for shipping pads such as, for example, polystyrene. A recess 152 in pad 150 is provided for partially encapsulating the edges of an item to be shipped 158 (FIG. 6), thereby providing protection against shock and vibration.

Figure 5:
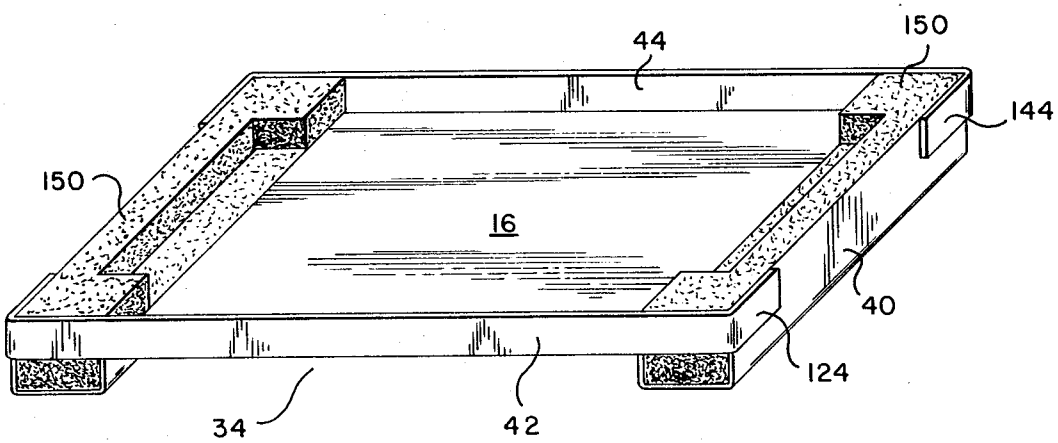
FIG. 5 is a perspective view of the shipping base shown with the polystyrene pads inserted therein.
Figure 6:
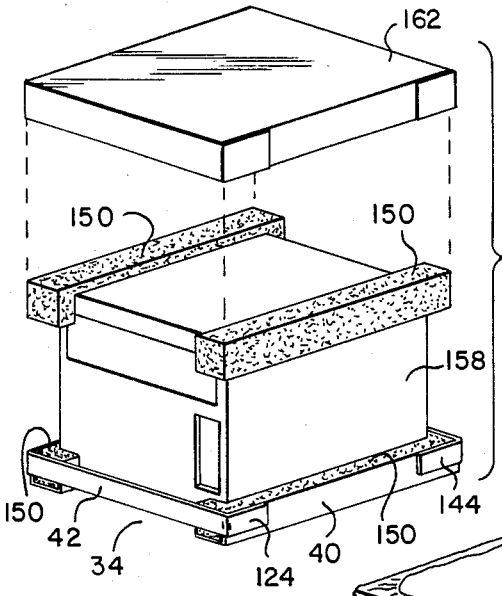
FIG. 6 is a perspective view of the shipping base shown with a shipping item inserted thereon.

FIG. 5 illustrates base 10 with one polystyrene pad 150 inserted in each of channels 22 and 28. Pads 150 are utilized in base 10 to support the weight of item 158 which is seated on pads 150 (FIG. 6). Item 158 may be any item having sufficient weight to require the use of material handling equipment such as, for example, a room air conditioning unit.

Figure 7:
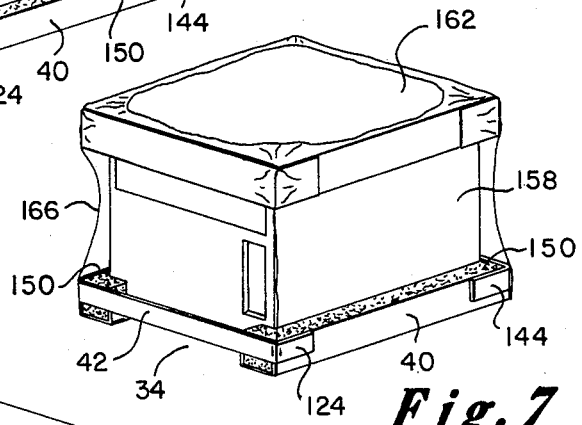
FIG. 7 is a perspective view of the shipping base and shipping item shown after shrink wrapping.

For illustrative purposes, one of several possible applications of base 10 in a complete shipping container is shown in FIGS. 6 and 7. Referring first to FIG. 6, opposing bottom edges of item 158 are encapsulated by two pads 150, each pad 150 being inserted in one of channels 22 and 28. Two additional pads 150 are also shown encapsulating opposing top edges of item 158 for additional protection during shipping. A cap 162 is used to partially enclose the top portion of item 158 and respective pads 150. An overwrap shrink film 166 or other flexible material capable of being placed under tension is then used to secure item 158, cap 162, pads 150 and base 10 together as shown in FIG. 7. Cap 162 is formed from a rigid material such as, for example, cardboard to prevent deformation of pad 150 by shrink film 166.

Figure 8:
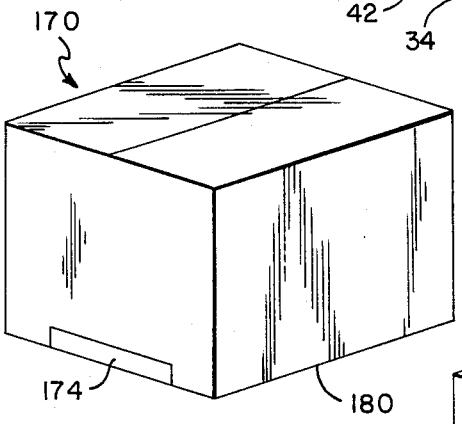
FIG. 8 is a perspective view of the cardboard sleeve.
Figure 9:
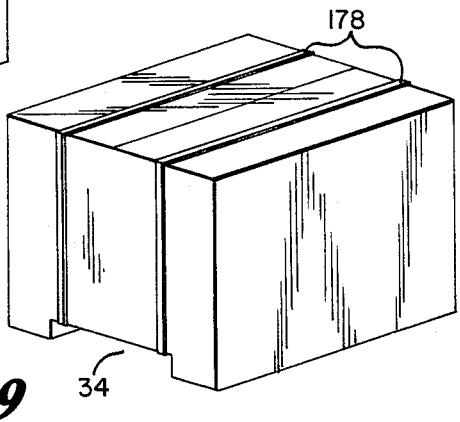
FIG. 9 is a perspective view of the cardboard sleeve shown attached to the shipping base.

Another possible application of base 10 in a complete shipping container is illustrated in FIGS. 8 and 9. Referring first to FIG. 8, a conventional cardboard sleeve 170 which is open at bottom end 180 is shown. Opposing foldable panels 174 are positioned in sleeve 170 for aligning with slot 34 of base 10 as described below. FIG. 9 illustrates a completed shipping unit wherein sleeve 170 is inserted over item 158 after it has been encapsulated with pads 150 and mounted on base 10 as previously described. Panels 174 are then folded under panel 16 of base 10 to prevent blocking of entry slot 34. Straps 178 circumscribe sleeve 170 and base 10 to secure them together as an integral shipping unit. Pads 150 further provide a protective air space between item 158 and sleeve 170 to prevent foreign objects from striking item 158 during shipping.

Those skilled in the art will recognize that the above possible applications of base 10 are illustrative only, and not meant to be limiting. It will also be recognized that base 10 may be designed to fit the bottom contour of almost any product which is partially encapsulated by protective pads in a conventional manner. In summary, shipping base 10 is easily formed from a unitary sheet of cardboard. Used in conjunction with conventional pads 150, shipping base 10 provides load bearing support to a shipping item 158 and eliminates the need of a pallet or similar device which would otherwise be required to provide an entry for material handling equipment.

This concludes the Description of the Preferred Embodiment. The reading of it by those skilled in the art will bring to mind many alterations and modifications without departing from the spirit and scope of the invention. Accordingly, it is intended that the scope of the invention be limited only by the following claims.

What is claimed is:

1. A shipping base for protecting the bottom of a load and elevating said load to provide an entry slot adapted for insertion of projecting prongs from a lifting device, comprising:

a rectangular horizontal panel having a first pair of opposing parallel edges and a second pair of opposing parallel edges, said first pair of opposing parallel edges being perpendicular to said second pair of opposing parallel edges;

a pair of rectangular vertical channels disposed along and integrally connected to said first pair of opposing parallel edges, said entry slot being defined by the space between said channels and below said horizontal panel;

each of said channels having an inner rectangular vertical wall attached to said first pair of opposing parallel edges, a bottom wall and an outer rectangular vertical wall, said outer walls being greater in height than the vertical distance between the bottom of said channel and said horizontal panel, said outer walls defining a first pair of upwardly extending rectangular vertical panels;

a second pair of upwardly extending rectangular vertical panels integrally connected to said second pair of opposing parallel edges, each of said second vertical panels having a pair of opposing transverse edges contiguous to said first pair of vertical panels, said first and second pair of vertical panels defining an open rectangular enclosure for partially enclosing said load, said panels and said channels being integrally formed from a unitary sheet of cardboard;

a quadruplicate of vertical flaps, each of said flaps being integrally attached to one of said opposing transverse edges of said second pair of rectangular vertical panels, said flaps being orthogonally bent from said second pair of panels thereby being adjacently disposed to said first pair of vertical panels, said flaps being integrally formed from said unitary sheet of cardboard;

means for attaching said flaps to said first pair of vertical panels thereby forming a rigid shipping base; and a pair of rectangular polymer pads for partially enclosing and protecting said load, each of said pads being positioned in each of said channels for supporting said load.

2. The shipping base recited in claim 1 wherein said pair of polymer pads are comprised of polystyrene.

3. A shipping base for protecting the bottom of a load and elevating said load to provide an entry slot for a mechanical lifting apparatus, comprising a horizontal rectangular panel having a first pair of opposing parallel edges and a second pair of opposing parallel edges, said first pair of opposing parallel edges being perpendicular to said second pair of opposing parallel edges;

a pair of rectangular vertical channels, each of said channels having an inner rectangular vertical wall, a bottom wall and an outer rectangular vertical wall, each of said inner walls having an upper edge being disposed along and integrally connected to one edge of said first pair of opposing parallel edges, said entry slot being defined by the space between said inner walls and below said horizontal panel;

said outer walls defining a first pair of rectangular vertical panels wherein said outer walls are greater in height than said inner walls;

a second pair of rectangular vertical panels each extending upward from and being integrally attached respectively to one of said second pair of opposing parallel edges, each of said second pair of vertical panels having a pair of opposing transverse edges contiguous to said first pair of vertical panels, said first and second pair of vertical panels defining an open rectangular enclosure for partially enclosing said load, said panels and said channels being integrally formed from a unitary sheet of cardboard;

a quadruplicate of vertical flaps, each of said flaps being integrally attached to one of said opposing transverse edges of said second pair of rectangular vertical panels, said flaps being orthogonally bent from said second pair of panels thereby being adjacently disposed to said first pair of vertical panels, said flaps being integrally formed from said unitary sheet of cardboard;

means for attaching said flaps to said first pair of vertical panels thereby forming a rigid shipping base; and a pair of rectangular polymer joists respectively positioned in said channels, each of said joists filling the air space defined by said channels and extending in height to the height of said first pair of vertical panels, each of said joists having a recess defining an open rectangular space adjacent to said first pair of opposing parallel edges for partially encapsulating said load, said recess defining a floor in said joists for supporting said load, said floor being in the same horizontal plane as said horizontal panel.

4. The shipping base recited in claim 3 further comprising a pair of polymer pads for partially enclosing and protecting the top of said load.

5. The shipping base recited in claim 4 further comprising:

a structure for encapsulating said load and said pair of polymer pads; and means for attaching said structure to said shipping base.

6. The shipping base recited in claim 5 wherein said pair of polymer joists and said pair of polymer pads are comprised of polystyrene.

7. A method for forming a shipping base for elevating the bottom of a load to provide an entry slot for a mechanical lifting device, said shipping base having a horizontal rectangular panel integrally connected to a pair of upwardly facing rectangular channels along opposing longitudinal edges of said panel, said shipping base having two vertical side panels integrally connected to said channels and two vertical end panels integrally connected along opposing transverse edges of said panel, said method comprising the steps of:

scoring six longitudinal lines in a rectangular sheet of cardboard defining the width of said panel, the height of said channels, the width of said channels and the height of said vertical side panels;

scoring two transverse lines in siad sheet of cardboard defining the height of said vertical end panels;

cutting said transverse lines from an outer edge of said sheet to said panel thereby defining two flaps in each of said vertical end panels, said flaps being adjacent to said cuts;

successively bending said sheet of cardboard along said longitudinal lines downwardly, outwardly and then upwardly from said panel towards said sheet outer edges thereby forming said channels and said vertical side panels;

bending said sheet of cardboard upwardly along said transverse lines thereby forming said vertical end panels;

bending said flaps inwardly towards said vertical side panels;

attaching said flaps to said vertical side panels; and positioning a polystyrene shipping pad in each of said channels for supporting said load, said pads being moldably formed to encapsulate the bottom longitudinal edges of said load.

* * * * *